US005341850A

United States Patent [19]

Froment et al.

[11] Patent Number: 5,341,850

[45] Date of Patent: Aug. 30, 1994

[54] HEDDLE FRAME LEVELLING APPARATUS FOR A ROCKING LEVER CAM DRIVE

[75] Inventors: Jean-Paul Froment, Doussard; Jean-Pierre Pages, Faverges, both of France

[73] Assignee: S.A. des Etablissements Staubli, Faverges, France

[21] Appl. No.: 86,034

[22] Filed: Jul. 6, 1993

[30] Foreign Application Priority Data

Jul. 10, 1992 [FR] France ..... 92 08898
Sep. 18, 1992 [FR] France ..... 92 11358

[51] Int. Cl.[5] ..... D03C 5/02
[52] U.S. Cl. ..... 139/79
[58] Field of Search ..... 139/79, 80, 81, 84, 139/75, 66 A

[56] References Cited

U.S. PATENT DOCUMENTS

| | | | |
|---|---|---|---|
| 3,752,194 | 8/1973 | Griffith | 139/79 |
| 3,946,766 | 3/1976 | Amigues | 139/79 X |
| 3,991,793 | 11/1976 | Demuth | 139/79 |
| 4,005,736 | 2/1977 | Pfarrwaller | 139/79 |
| 4,614,212 | 9/1986 | Olenwine | 139/79 |

*Primary Examiner*—Andrew M. Falik
*Attorney, Agent, or Firm*—Dowell & Dowell

[57] ABSTRACT

In a weaving machine with a cam mechanism for forming the shed a heddle frame levelling apparatus includes rocking levers which are pivoted about a pin which is urged against a fixed bearing surface on the frame of the machine during weaving by elastically deformable elements. In a first embodiment the movement of the pivot pin is effected by the rotation of an eccentric bearing whereas in a second embodiment this movement is caused by a jack.

10 Claims, 6 Drawing Sheets

HEDDLE FRAME LEVELLING APPARATUS FOR A ROCKING LEVER CAM DRIVE

BACKGROUND OF THE INVENTION

1. Field of the Invention

The present invention relates to cam mechanisms used for forming the shed in weaving machines.

2. History of the Related Art

The term "cam mechanism" is known generally to designate an assembly comprising a series of rocking levers, in a number equal to that of the heddle frames mounted on the weaving machine. Each rocking lever, coupled to one of the frames, is provided with two rollers which cooperate with the two sectioned tracks of a complementary cam driven in rotation by a common shaft connected to that of the corresponding weaving machine. It will be understood that the drive of these cams, which are suitably offset angularly with respect to one another, on the common shaft, ensures control of the levers and the reciprocating vertical displacement of the heddle frames.

Experience has shown that, whenever the weaving machine stopped, either at the end of work or for the purpose of a momentary intervention on the machine or the cam mechanism, all the heddle frames had to be brought to the same height. To that end, the mechanisms are generally provided with a so-called "levelling" device which may take different forms, but of which the most current structure is that schematically shown in FIG. 1 of the drawings accompanying the present specification.

In this FIG. 1, reference 1 designates one of the rocking levers coupled to one of the heddle frames CL of the weaving machine, while reference 2 corresponds to the two rollers which are offset laterally with respect to each other to cooperate with the two tracks of a complementary cam 3, fitted on a drive shaft 4. The different rocking levers 1 of the mechanism are mounted idly on a common pin 5 oriented parallel to the shaft and it will be observed that each of the small-diameter ends 5*a* of this pin 5 is supported by an eccentric 6 of circular profile, housed in a cylindrical bore of a bearing 7 secured to the frame of the mechanism.

It will be readily appreciated that if, after the drive shaft 4 has stopped, the two eccentrics 6 are rotated in their bearings 7, the common pin 5 on which all the levers 1 pivot moves in the direction of the arrow appearing in FIG. 1. This recoil movement of the pin brings all the levers 1 in abutment against a fixed stop 8 of the frame 9 of the mechanism.

Consequently, all the rocking levers 1 are brought to the same angular orientation, whatever, at the moment of stop, the orientation of their complementary cam 3.

The present invention is based on the observation that the assembly of the ends 5*a* of the pin 5 inside the eccentrics 6 and the maintenance of the latter in the bearings 7 were detrimental to the rigidity of the point of fixation of the pin. During normal operation (weaving) of the mechanism, this pin is subjected to very high forces and to considerable vibratory effects. These forces and vibrations rapidly wear the pieces which support the pivot pin, generating the formation of rust in the bearings 7, as well as the appearance of a residual clearance detrimental to correct functioning of the mechanism assembly.

It is a principal object of the present invention to overcome this drawback.

SUMMARY OF THE INVENTION

To that end, the present invention relates to a cam mechanism for forming the shed in weaving machines, of the type in which the ends of the pivot pin which supports the rocking levers coupled to the heddle frames are carried by two eccentrics which cooperate with the frame of the mechanism so that the rotation of the eccentrics under the effect of maneuvering means provokes, by transverse displacement of the pin and rocking of the levers which abut against a stop, the levelling of the assembly of the heddle frames. The comprises means adapted to exert on the ends of the pivot pin a force which tends to apply the latter elastically against fixed bearing surfaces in the frame of the mechanism during normal operation thereof.

In fact, the invention essentially consists in causing elastic means to act on the ends of the pivot axis, which elastic means are adapted to maintain the ends very firmly pressed against fixed bearing surfaces secured to the frame of the mechanism.

Tests have shown that the forces of contact thus obtained between the pin and its bearing surfaces, coupled with the forces of adherence following therefrom, radically opposed all the micro-displacements observed in the conventional constructions.

BRIEF DESCRIPTION OF THE DRAWINGS

The invention will be more readily understood on reading the following description with reference to the accompanying drawings, in which.

As indicated hereinbefore, FIG. 1 schematically shows the structure of the conventional levelling devices.

DESCRIPTION OF THE PREFERRED EMBODIMENT

Figure 1:
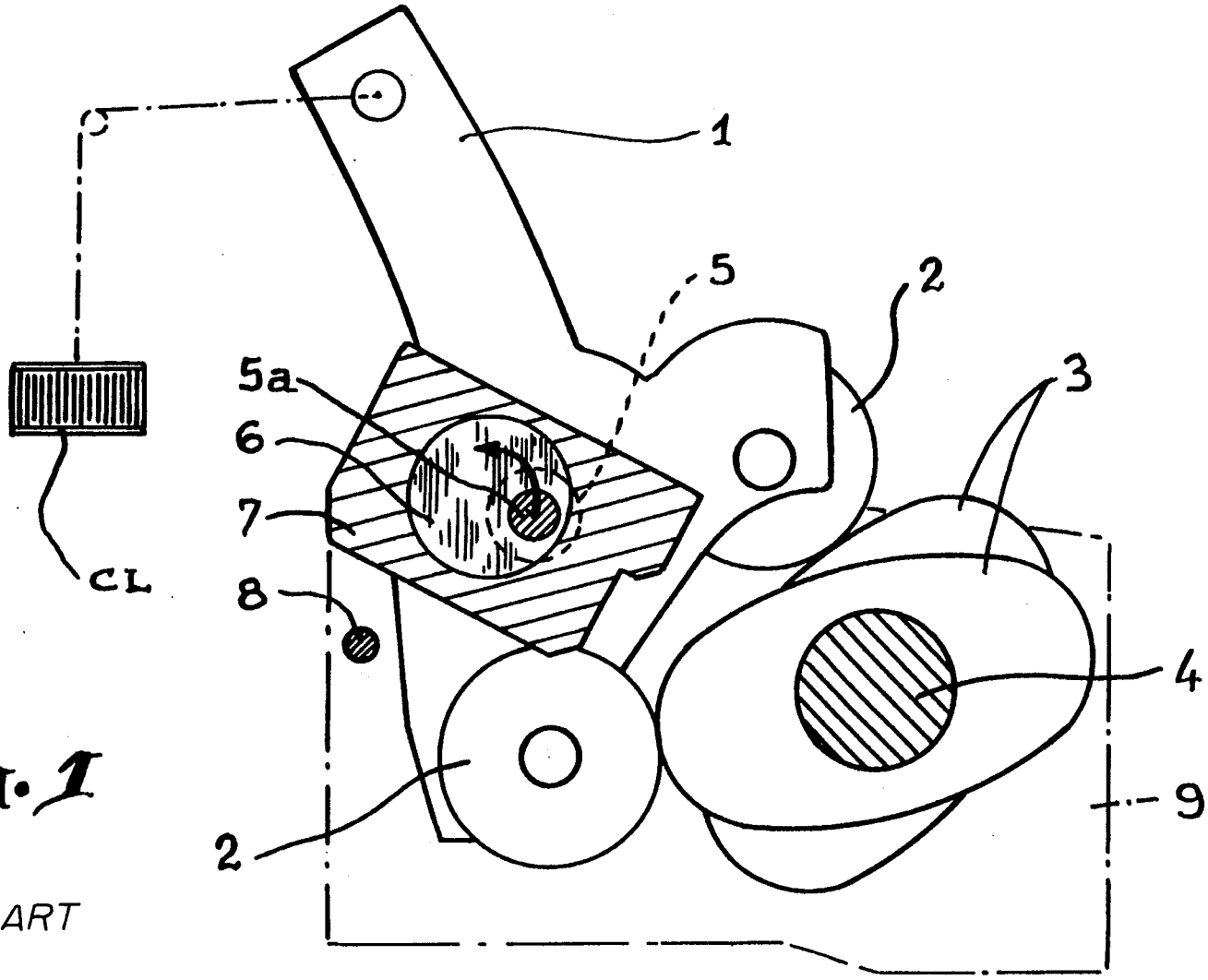
Fig. 1 PRIOR ART
Figure 2:
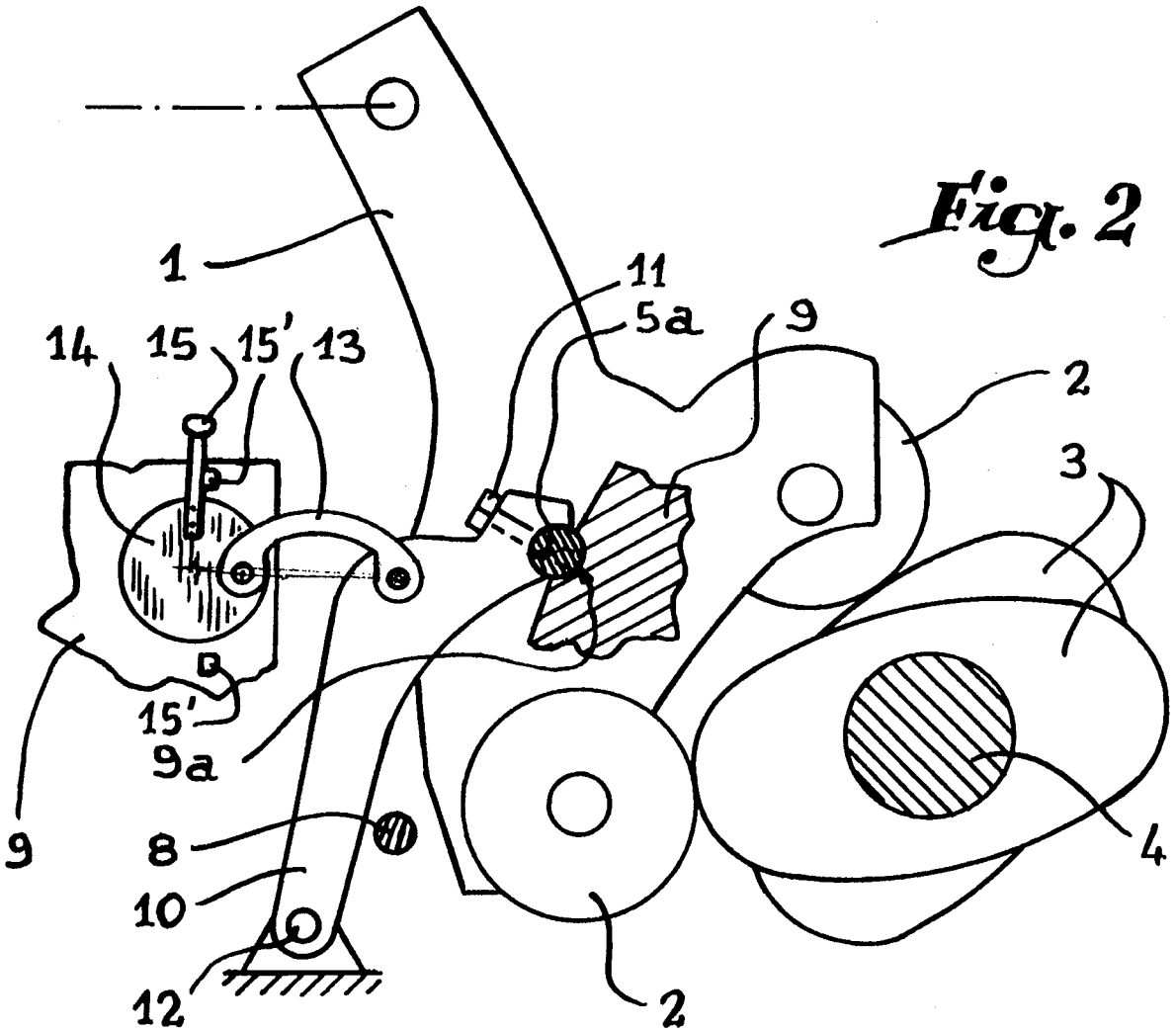
FIG. 2 illustrates in the same manner the arrangement of a mechanism equipped with a levelling device according to the invention.

Referring again to the drawings, FIG. 2 shows the rocking lever 1 provided with its two rollers 2 cooperating with the tracks of a complementary cam 3 fitted on a drive shaft 4. All the levers 1 of the mechanism pivot about a common pin 5 adjacent which is arranged the levelling device which includes a system of eccentrics adapted to bring said pin to a position for which the rollers 2 are no longer in contact with the cams 3.

In the embodiment shown, these eccentric assemblies are in the form of two lateral arms 10 of which the upper end supports, for example by screws 11, the corresponding end 5*a* of the pin 5, while the lower end is mounted on a pivot 12 secured to the frame 9 of the mechanism. Adjacent its upper end, each arm 10 is coupled by a connecting rod 13 to a cylindrical eccentric 14 engaged in a bore of the frame 9 and provided with a means for rotating, shown schematically in the form of a handle 15, adapted to move between two fixed angular end-of-stroke stops indicated at 15'.

In the position of weaving illustrated in FIG. 2, the eccentrics 14 are oriented so that, in their bearing, the connecting rods 13, which are an arcuate profile so as to be capable of a slight elastic deformability along their axis, tend to push arms 10 elastically in the direction of the shaft 4. Under these conditions, the system applies to the pivot pin 5 an elastic pre-load which tends to maintain its ends applied against two bearing surfaces 9*a* provided in the frame 9. The pin 5 is thus perfectly immobilized and the wear generated by the vibrations imparted to this pin 5 during weaving is consequently avoided.

Figure 3:
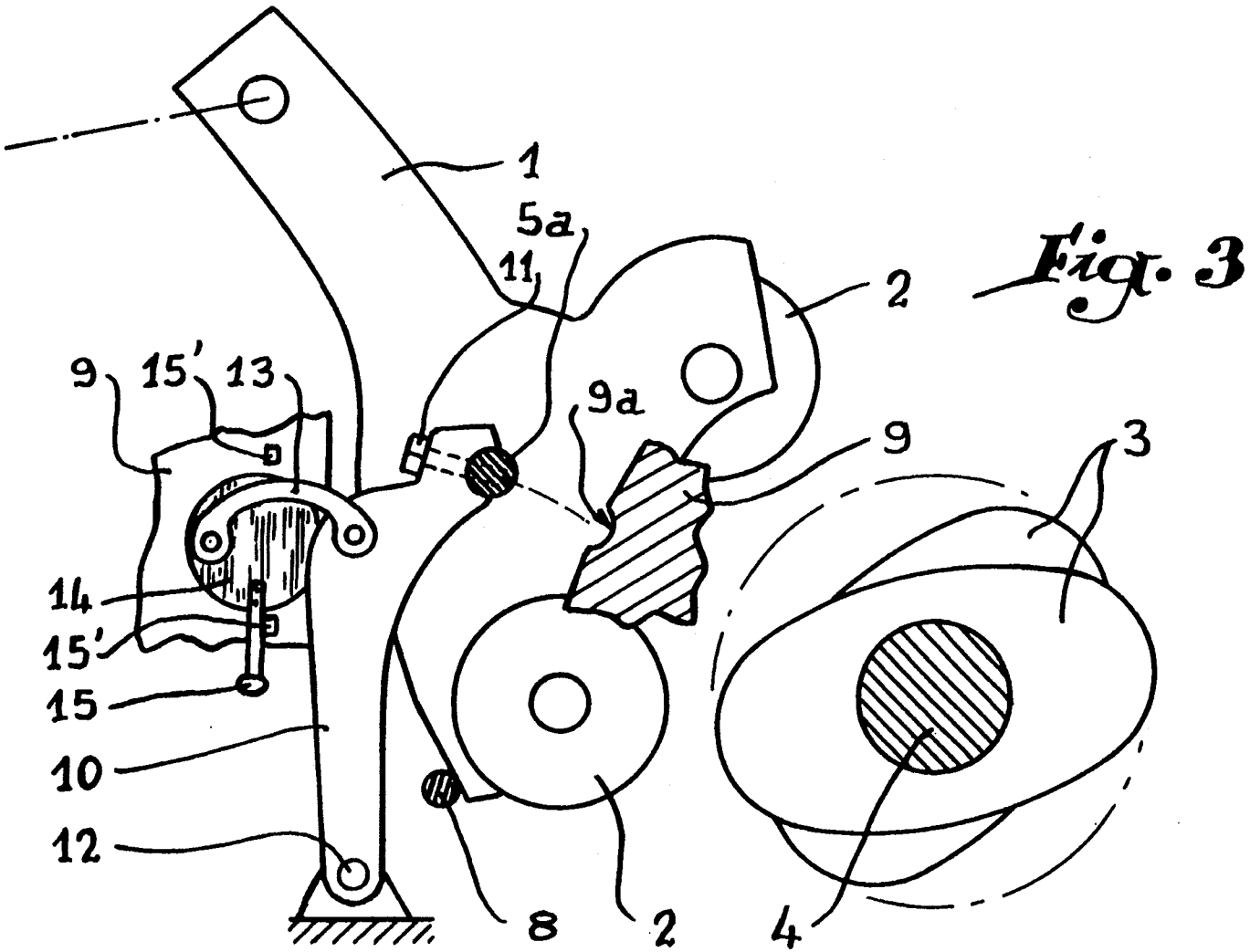
FIG. 3 reproduces FIG. 2 in position of levelling.

The elastic pre-stress thus created extends its beneficial effects to the whole control system, avoiding any appearance of rust in the area of the articulations. Furthermore, it will be observed that the two positions according to FIGS. 2 and 3 are perfectly stable, the two lateral assemblies 13–14 being comparable to knuckle joint systems exceeding dead center are limited in angular displacement by the two stops 15'.

Figure 4:
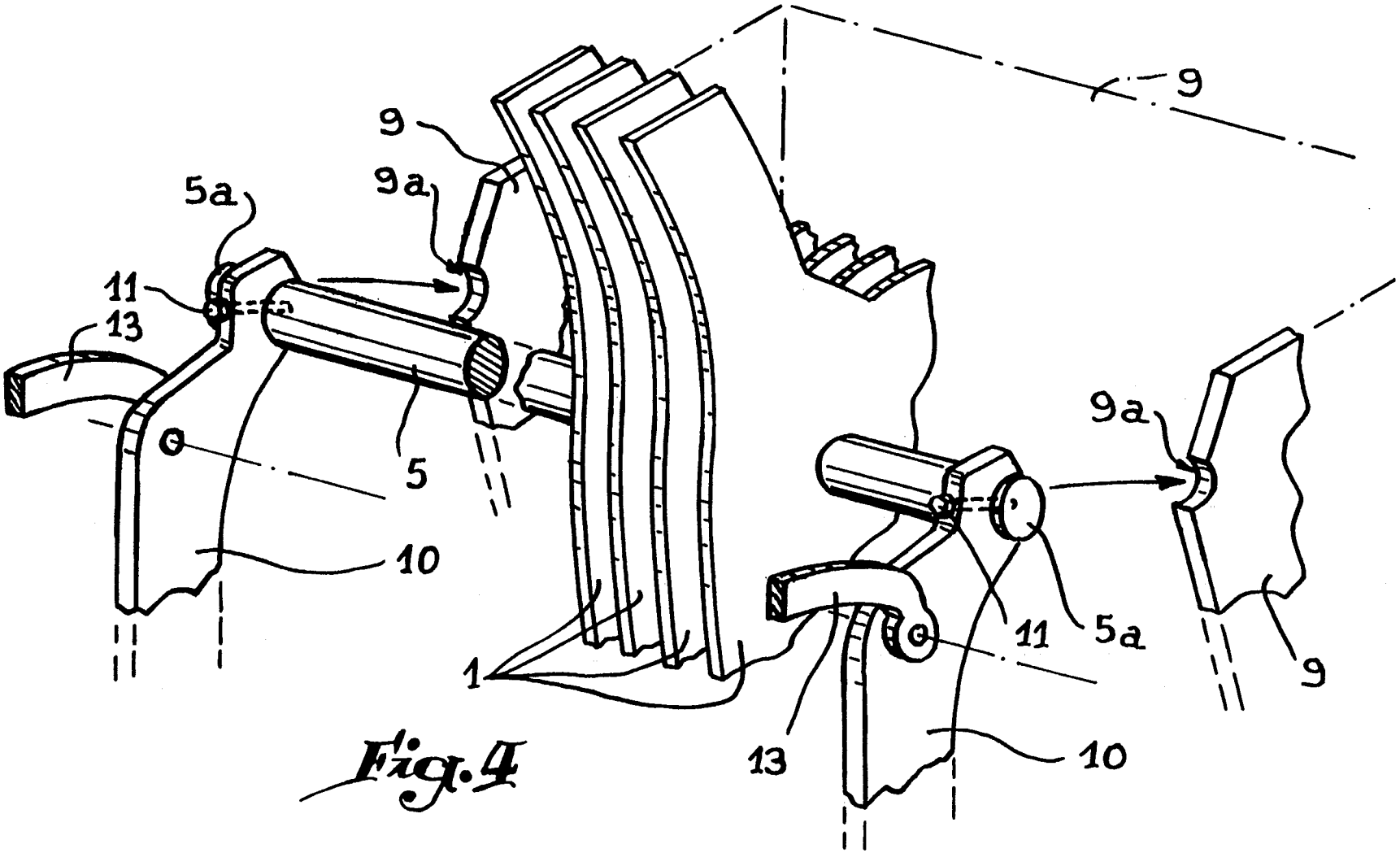
FIG. 4 is a view in perspective clearly showing the assembly of the pivot pin.

Of course, it suffices to move the handle 15 to effect levelling of all the levers 1 of the mechanism. As illustrated in FIGS. 3 and 4, the angular displacement of the two eccentrics 14 initially stops the buttressing exerted on the pin 5, then causes the latter to recoil with respect to the shaft 4 until the levers 1 abut against the fixed stop 8, the rollers 2 in that case no longer being in contact with the cams 3.

It goes without saying that other forms of embodiment may be imagined for the means which act elastically on the pivot pin 5 during the weaving operations.

Figure 5:
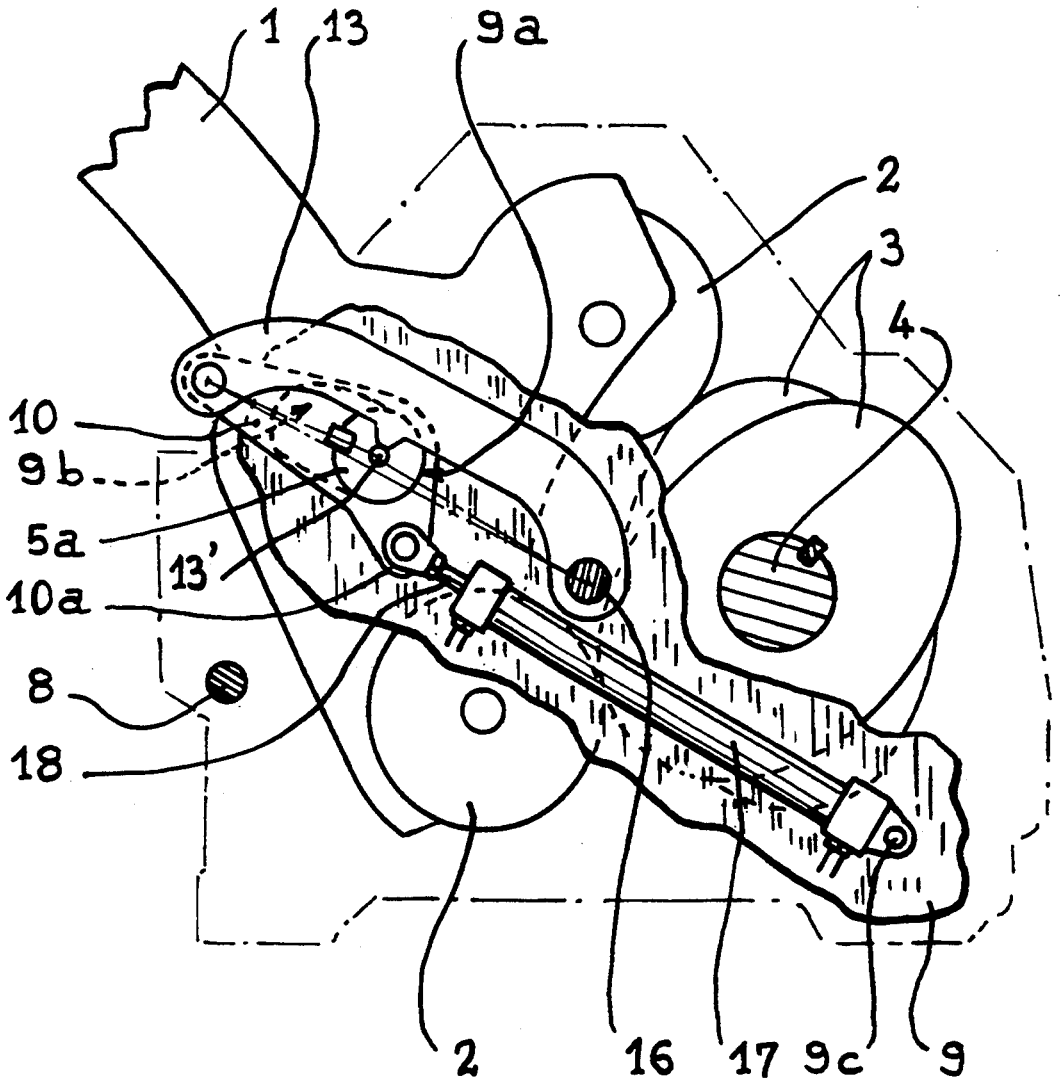
FIGS. 5 and 6 are schematic vertical sections similar to those of FIGS. 2 and 3, but illustrating another embodiment of the invention.
Figure 6:
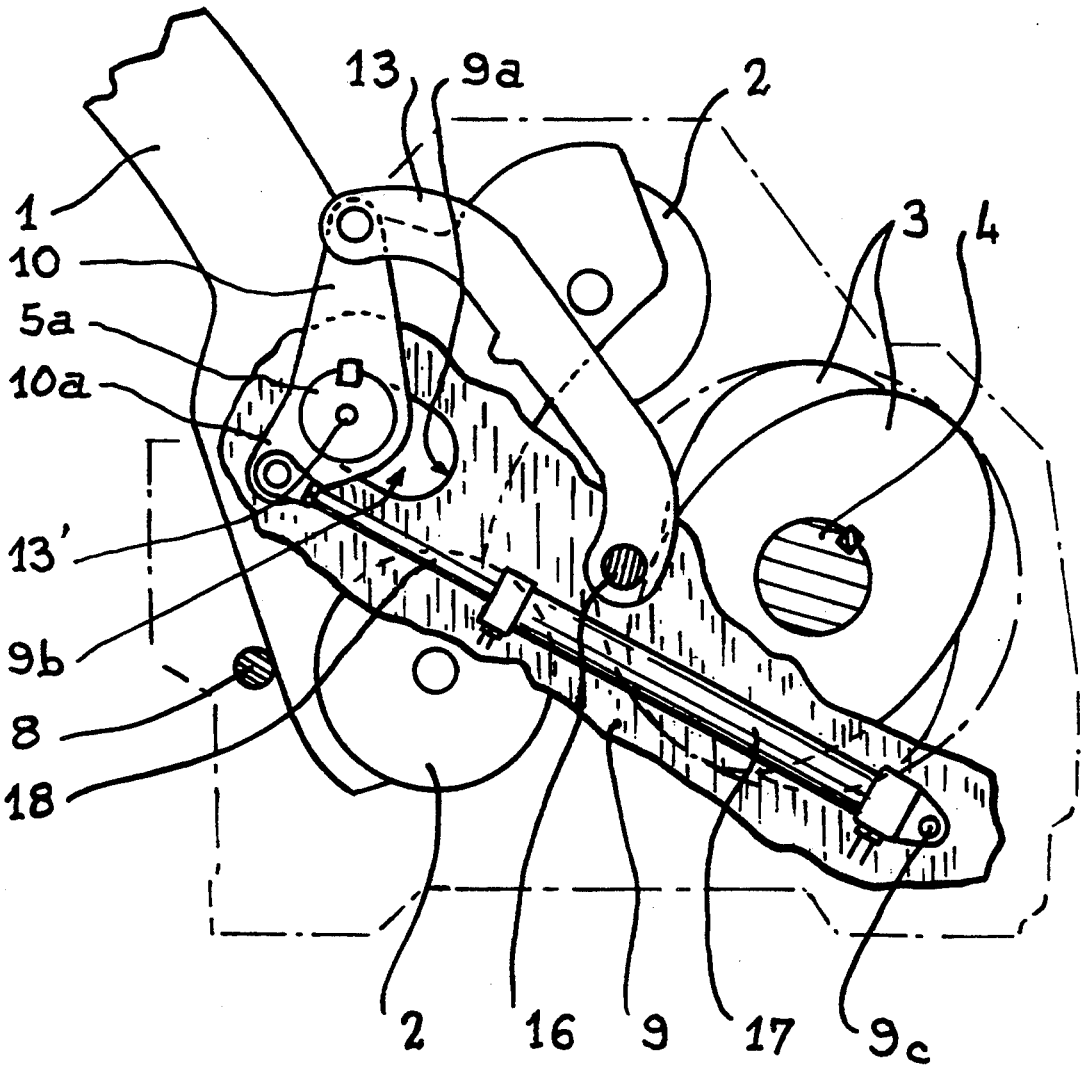

In the embodiment illustrated in FIGS. 5 and 6, the ends 5*a* of the pin 5 are carried by eccentrics or arms 10 of short length, in the manner of crank pins oriented radially with respect to the pin. The free end of each arm 10 is coupled to an arcuate connecting rod 13 which is articulated on the frame 9 via a lateral pivot pin 16, located between pin 5 and shaft 4. The ends 5*a* of pin 5 are engaged in slots 9*b* made in the frame 9, the axis of each slot 9*b* being oriented substantially at right angles to the direction of guiding that the connecting rods 13 exert on the arms 10 when the latter pivot to pass from the position of weaving according to FIG. 5 to the position of levelling according to FIG. 6.

For actuating the levelling device at least one lateral jack is provided, whose cylinder 17 is articulated at 9*c* on frame 9, while the piston rod 18 is coupled to a lug 10*a* on arm 10. The mean position of this lug 10*a* is perpendicular to the axis of jack 17–18, so that actuation of the latter is translated by a rotation of the arms 10 and of the shaft 5 causing the passage from one to the other of the arrangements shown in FIGS. 5 and 6. Here, too, a stop 13' is provided to limit the amplitude of the angular displacement of the connecting rods 13.

Operation of the device is similar to that set forth with reference to FIGS. 2 to 4. Effectively, the end, referenced 9*a*, of the slots 9*b* which faces shaft 4 replaces the bearing surfaces 9*a* of FIGS. 2 to 4. Under these conditions, in the position according to FIG. 5, the connecting rods 13 apply to the pivot pin 5 an elastic pre-load which opposes any untimely displacement of the pin, while, in the levelled position of FIG. 6, the actuation effected by the jack or jacks 17–18 has brought the assembly of the levers 1 in abutment against the fixed stop 8 by transverse sliding of the ends 5*a* of this pin 5 in the slots 9*b*.

In this case too, the locked position of equilibrium according to FIG. 5, i.e. after the point of maximum extension of the connecting rods 13 has been exceeded, is rendered stable by the presence of the fixed stops 13'.

It should be observed that the slide of the ends 5*a* in the slots 9*a* is effected in a virtually rectilinear path, avoiding any displacement of the heddle frames CL in the direction of opening of the shed.

What is claimed is:

1. In a weaving machine having a cam mechanism for forming a shed wherein the cam mechanism includes rocking levers connected to heddle frames, the rocking levers being supported on a pivot pin which is carried by eccentric assemblies so as to be shiftable relative to a frame portion of the machine from a first position wherein the rocking levers are engageable with cam means to a second position adjacent a stop, the improvement comprising said stop being defined by a fixed bearing surface associated with the frame portion, means for elastically urging the pivot pin against said fixed bearing surface when in said first position, and maneuvering means for controlling movement of the eccentric assemblies.

2. The weaving machine and cam mechanism of claim 1 in which said eccentric assemblies include two pivotable arms and said means for elastically urging includes deformable connecting rods connected to said pivotable arms.

3. The weaving machine and cam mechanism of claim 2 in which said deformable connecting rods are arcuately profiled having opposite ends.

4. The weaving machine and cam mechanism of claim 3 in which said pivotable arms having first ends to which said pivot pin is mounted and second ends, and pivot means for securing said second ends to the frame portion.

5. The weaving machine and cam mechanism of claim 4 in which said maneuvering means includes cylindrical eccentrics mounted to the frame portion, and means for rotating said cylindrical eccentrics.

6. The weaving machine and cam mechanism of claim 5 including a pair of stop means mounted to the frame portion adjacent said cylindrical eccentrics, one of said stop means being engageable by said means for rotating when said rocking levers are in said first position and the other of said stop means being engageable by said means for rotating when said rocking levers are in said second position.

7. The weaving machine and cam mechanism of claim 5 in which one of said opposite ends of said deformable connecting rods is connected to said pivotable arms intermediate said first and second ends thereof and the other of said opposite ends are connected to said cylindrical eccentrics.

8. The weaving machine and cam mechanism of claim 3 in which the frame portion includes slots having one end which forms said fixed bearing surface, said pivot pin being slidable received within said slots, said pivotable arms being mounted to said pivot pin and having a first end connected to one of said opposite ends of said deformable connecting rods and a second end connected to said maneuvering means.

9. The weaving machine and cam mechanism of claim 8 including a second pivot means for securing the other of said opposite ends of said deformable connecting rods to the frame portion.

10. The weaving machine and cam mechanism of 9 in which said maneuvering means includes a jack having a cylinder and piston rod, means for connecting said cylinder relative to the frame portion and means for connecting said piston rod to said second end of said pivotable arm.

* * * * *